US005945626A

United States Patent [19]

Robbins

[11] Patent Number: 5,945,626

[45] Date of Patent: Aug. 31, 1999

[54] GAS OPERATED FIREARM WITH CLAMP ON GAS BLOCK

[75] Inventor: Laurance E. Robbins, Plainville, Conn.

[73] Assignee: Colt's Manufacturing Company Inc., West Hartford, Conn.

[21] Appl. No.: 08/925,960

[22] Filed: Sep. 9, 1997

[51] Int. Cl.[6] ..... F41A 5/26

[52] U.S. Cl. ..... 89/193; 42/100

[58] Field of Search ..... 89/191.01, 191.02, 89/192, 193; 42/100

[56] References Cited

U.S. PATENT DOCUMENTS

| | | | |
|---|---|---|---|
| 1,234,071 | 7/1917 | Northover | 89/193 |
| 2,454,251 | 11/1948 | Hamilton | 89/191.01 |
| 3,236,155 | 2/1966 | Sturtevant | 89/199 |
| 3,330,183 | 7/1967 | Loffler | 89/193 |
| 3,333,509 | 8/1967 | Muhlemann | 89/193 |
| 3,618,457 | 11/1971 | Miller | 89/185 |
| 3,893,370 | 7/1975 | Hutton et al. | 89/193 |
| 4,178,832 | 12/1979 | Crowell | 89/159 |
| 4,536,982 | 8/1985 | Bredbury et al. . | |
| 4,658,702 | 4/1987 | Tatro | 89/139 |
| 4,663,875 | 5/1987 | Tatro | 42/71.01 |
| 4,798,124 | 1/1989 | Hurlemann et al. | 89/193 |
| 5,068,968 | 12/1991 | Sillery | 33/233 |
| 5,247,758 | 9/1993 | Mason | 42/75.02 |
| 5,768,818 | 6/1998 | Rustick | 42/75.02 |

FOREIGN PATENT DOCUMENTS

| | | | |
|---|---|---|---|
| 716647 | 12/1941 | Germany | 89/193 |
| 1925 | 2/1915 | United Kingdom | 89/191.02 |

*Primary Examiner*—Charles T. Jordan
*Assistant Examiner*—Christopher K. Montgomery
*Attorney, Agent, or Firm*—Perman & Green, LLP

[57] ABSTRACT

A firearm comprising a receiver, a barrel and a gas block. The barrel is connected to a front end of the receiver. The gas block is clamped onto the barrel. A gas tube extends between the receiver and the gas block, and the gas block includes a keyway which engages a key piece on the barrel.

16 Claims, 2 Drawing Sheets

GAS OPERATED FIREARM WITH CLAMP ON GAS BLOCK

BACKGROUND OF THE INVENTION

1. Field of the Invention

The present invention relates to firearms and, more particularly, to a gas block for a gas operated firearm.

2. Prior Art

Gas operated M-16 style firearms are generally well known in the art. They include a gas tube connected between the front sight and the receiver. The front sight is affixed to the barrel by pins. Examples of this configuration are shown in U.S. Pat. Nos. 3,236,155; 4,536,982; and 4,663,875.

SUMMARY OF THE INVENTION

In accordance with one embodiment of the present invention, a firearm is provided comprising a receiver, a barrel, a gas block and a gas tube. The barrel is connected to a front end of the receiver. The gas block is clamped to the barrel. The gas tube extends from the gas block into the receiver.

In accordance with another embodiment of the present invention, a gas-operated M-16 style of firearm is provided having a receiver, a stock, a barrel, a handguard, and a gas tube. The stock is connected to an end of the receiver and the barrel is connected to a front of the receiver. The handguard is connected to the barrel. A gas block is stationarily fixed to the barrel. The gas tube extends from the gas block to the receiver. The gas block has two cantilevered arm sections that extend along opposite sides of the barrel and are connected to each other by a fastener to clamp the barrel between the two arm sections.

In accordance with another embodiment of the present invention, a firearm is provided comprising a receiver, a barrel and a gas block. The barrel is connected to a front of the receiver. The gas block is clamped to the barrel. The gas block has a fastener removably connected thereto to clamp the gas block around and onto the barrel.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
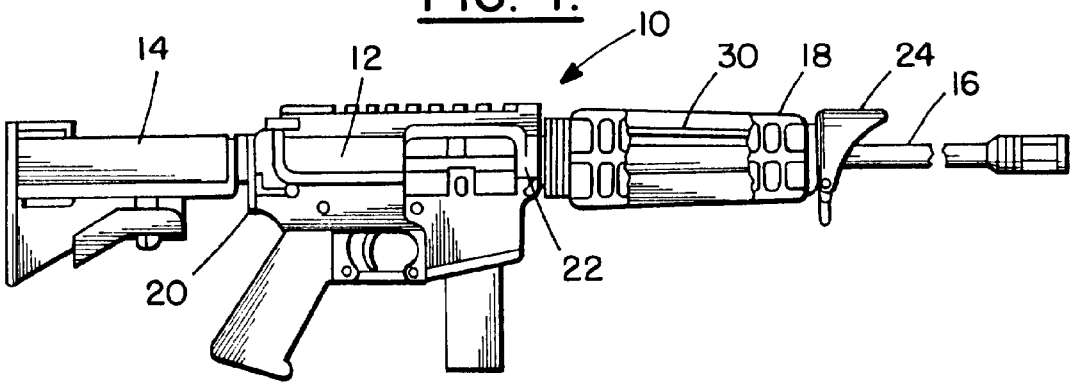
FIG. 1 is a side elevation view of a M-16 style firearm incorporating features of the present invention.

Referring now to FIG. 1, there is shown a side elevation view of a gas operated, M-16 style firearm 10 incorporating features of the present invention. Although the present invention will be described with reference to the embodiments shown in the drawings, it should be understood that features of the present invention can be embodied in various different forms of alternate embodiments. Features of the present invention can be embodied in various different types of firearms. In addition, any suitable size, shape or type of elements or materials could be used.

Figure 2:
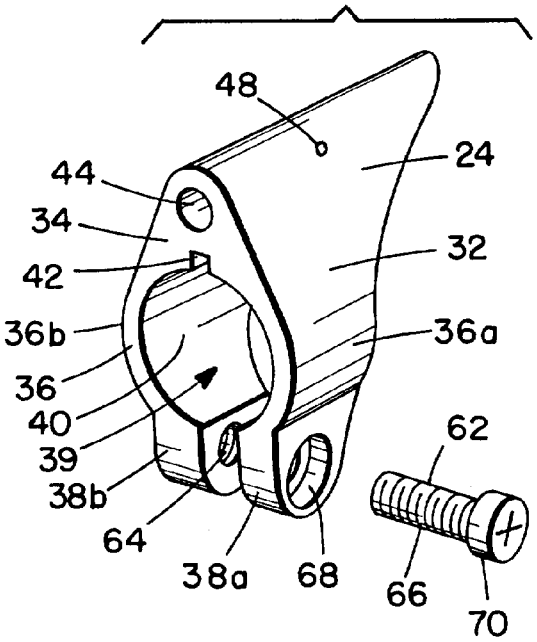
FIG. 2 is a perspective view of the gas block used in the firearm shown in FIG. 1.
Figure 3:
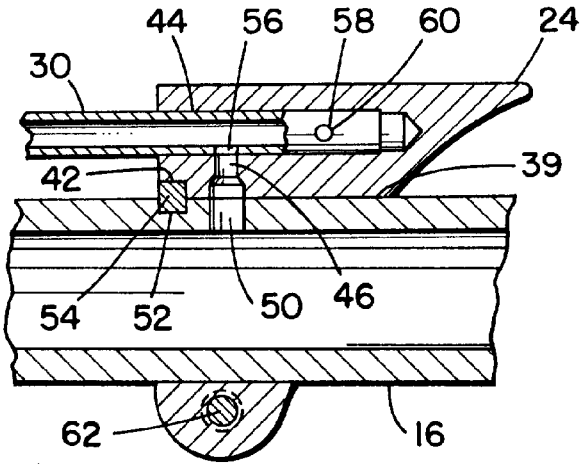
FIG. 3 is a partial cross-sectional view of the barrel, gas tube and gas block of the firearm shown in FIG. 1.

The firearm 10 has a receiver 12, a stock 14, a barrel 16 and a handguard 18. The stock 14 is connected to the rear end 20 of the receiver 12. The barrel 16 is connected to the front end 22 of the receiver 12. The handguard 18 is connected to the front of the receiver 12. The firearm 10 has a gas block 24 affixed to the barrel 16 near the front of the handguard 18. Referring also to FIGS. 2 and 3, the gas operated firearm 10 has a gas tube 30 to return gases from the barrel 16 to the receiver 12. The gas tube 30 extends from the gas block 24 through the handguard 18 into the receiver 12. The configuration of the connection between the gas tube 30 and the receiver 12 is well known in the art and will not be described further.

Referring principally to FIG. 2, the gas block 24 preferably has a one piece body 32 made from metal and a fastener 62. The body 32 has a general open channel configuration with an upper dorsal section 34, a central barrel receiving section 36 and a pair of lugs 38*a*, 38*b* located at the bottom of the barrel receiving section 36. The barrel receiving section 36 has two side arm sections 36*a*, 36*b* that extend downward from the upper dorsal section 34 in a general cantilevered fashion. The arm sections 36*a*, 36*b* form a channel 39 therebetween with a barrel contact surface 40 generally conforming to the circumference of the barrel 16. The contact surface 40 has a stepped recess 42 formed therein at the bottom rear end of the upper dorsal section 34. The upper dorsal section 34 of the gas block 24 has a passage 44 formed therein to receive the front end of the gas tube 30. The passage 44 extends into the upper dorsal section from the rear end of the body 32 and has a closed front end. As seen in FIG. 3, between the barrel receiving channel 39 and the passage 44 is a porthole 46. As seen in FIG. 2, the body 32 also has a side pin hole 48.

The barrel 16 has a gas exit port 50 similar to the prior art. However, in the embodiment shown, the barrel 16 also has a pin recess 52. The pin recess 52 is located at the top side of the barrel 16 directly behind the gas exit port 50. Press-fit mounted in the pin recess 52 is a pin 54. The pin extends outward from the top of the barrel in a general radial direction. When the gas block body 32 is positioned onto the barrel, the top of the pin 54 is received in the recess 42. This precisely aligns the porthole 46 with the gas exit port 50. The front end of the gas tube 30 has a bottom side gas entrance port 56 and a side pin hole 58. When the front end of the gas tube 30 is inserted into the passage 44, the side pin hole 58 of the tube 30 is aligned with the side pin hole 48 in the gas block 24. A pin 60 is then press-fit into the two holes 48, 58 to fixedly attach the gas block 24 with the gas tube 30. This also precisely aligns the bottom side gas entrance port 56 with the porthole 46.

As noted above, the gas block 24 includes a fastener 62. The left side lug 38*b* has a threaded aperture 64. The fastener 62 has a complementary threaded stem 66. The right side lug 38*a* has a through-hole with an enlarged recessed seat 68. The seat 68 is sized to receive the head 70 of the fastener 62. With the body 32 in place on the barrel 16, the fastener 62 is attached to the lugs 38. The fastener 62 pulls the two lugs 38 towards each other. The cantilevered arm sections 36*a*, 36*b* are deflected towards each other to circumferentially clamp the body 32 onto and around the barrel 16 and thereby form a fixed stationary, but removable connection. This also helps to form a seal between the two members 16, 32 at the junction of the gas exit port 50 and the porthole 46.

Figure 4:
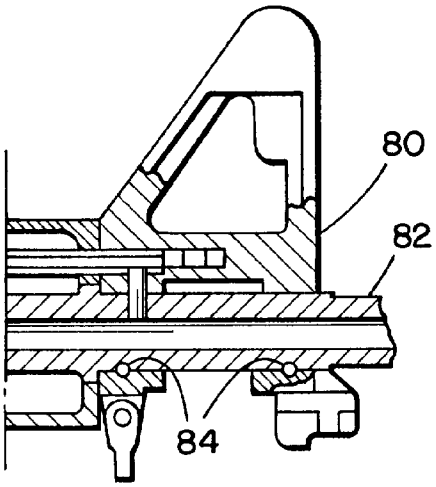
FIG. 4. PRIOR ART
FIG. 4 is a partial cross-sectional view of a barrel and gas tube assembly of the prior art.

Referring to FIG. 4, in the prior art connection of the front sight 80 to the barrel 82, the bottom of the barrel 82 was machined to accept two pins 84. The pins 84 held the front sight 80 in a stationary fixed position on the barrel 80. However, this method of connection had two disadvantages. First, the pin receiving channels in the bottom of the barrel 82 were difficult to machine because they were being drilled at a tangential angle to the curved outer surface of the barrel. Second, because the pins 84 were press-fit into place, they were not intended to be removable. Only a skilled gunsmith could remove the front sight and, even then, there was a risk of damaging the firearm and this was a time consuming process.

The present invention, on the other hand, provides a gas block that is relatively easy to remove. The recess 52 is relatively easy to machine into the barrel 16 because it is made in a radial direction. A person can attach or remove the gas block 24 with a single screw driver or allen wrench. Thus, the gas block 24 can be attached and removed in much less time than in the prior art and with much less effort. This also enables the firearm 10 to be relatively quickly and easily configured and/or reconfigured with different types of front gas blocks.

Figure 5:
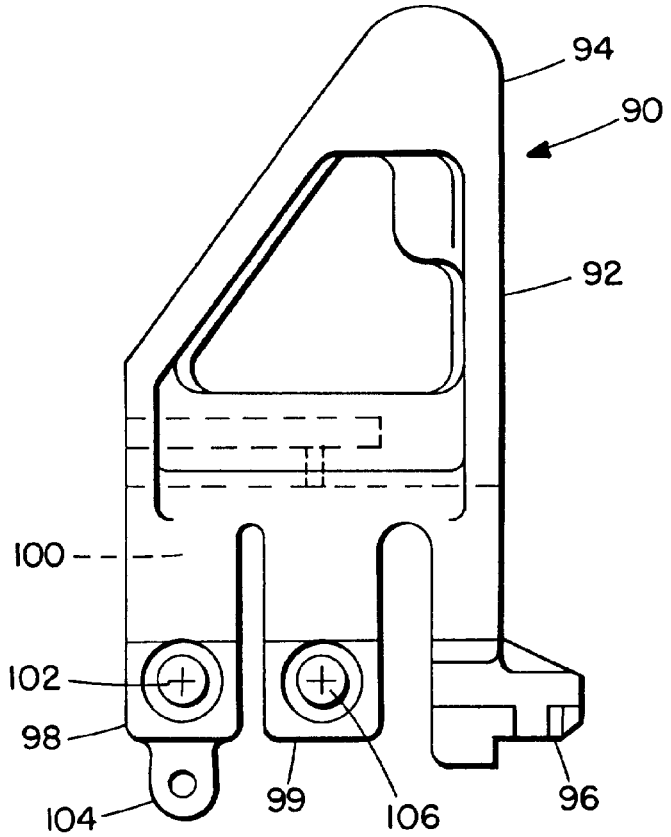
FIG. 5 is a side elevation view of an alternate embodiment of the gas block of the present invention.

In the embodiment shown in FIGS. 1–3, the gas block 24 merely performs the function of functionally connecting the gas tube to the barrel. Referring also to FIG. 5, an alternative embodiment is shown. In this embodiment the unit is a combined gas block and front sight 90. The one-piece metal body 92 has a top front sight section 94, a bayonet lug 96, and two pairs of side arm sections 98, 99. The body 92 has a barrel receiving area 100. The rear pair of side arm sections 98 extend on opposite sides of the barrel and are clamped around and onto the barrel by a first fastener 102. The rear pair of side arm sections 98 also have a swivel mount 104 for a carry sling swivel. The front pair of side arm sections 99 also extend on opposite sides of the barrel and are clamped around and onto the barrel by a second fastener 106. The front of the body has a continuous loop which the bayonet lug 96 extends from. The firearm 10 can be configured to have either the gas block 24 or the combined gas block and front sight 90. In alternate embodiments, other alternate types of front sights and/or other features could be provided with the clamp-on gas block feature of the present invention. Thus, the firearm 10 can be relatively easily configured and/or reconfigured for different tasks or desires.

Figure 6A:
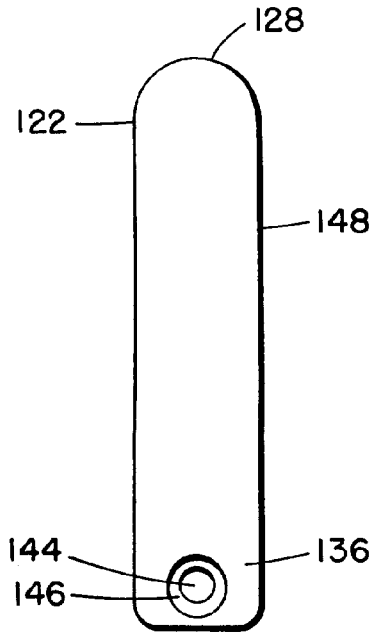
FIG. 6A is a side elevational view of another alternate embodiment of the present invention.
Figure 6B:
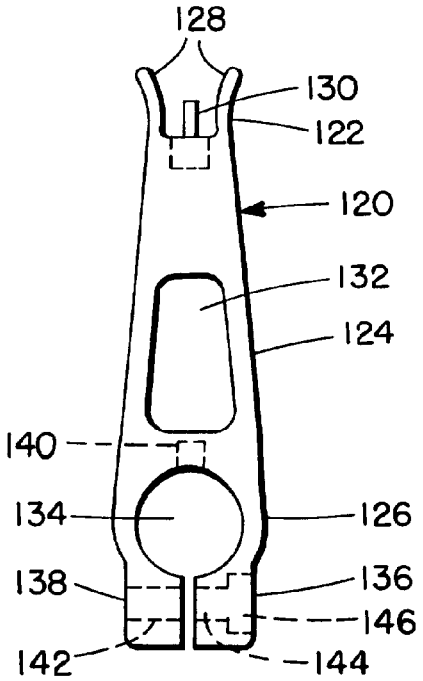
FIG. 6B is a front elevational view of the embodiment shown in FIG. 6A.

Referring now to FIGS. 6A and 6B another alternate embodiment is shown. In this embodiment the block 120 is a clamp-on front sight, but does not include the gas block function. This type of block can be used for a M-16 style blow-back type firearm, such as a COLT 9 mm submachine gun or carbine. COLT is a registered trademark of New Colt Holding Corporation. The block 120 is a one-piece metal member with a top end 122, a middle 124, and a bottom end 126. The top end 122 has two outwardly curved side fins 128. Adjustably mounted to the top end 122 is a sight pin 130. The middle 124 has a hole 132 to reduce the weight of the block. The bottom end 126 has a barrel hole 134, two downwardly extending cantilevered side legs 136, 138 and a pin receiving notch 140. The barrel hole 134 is sized to fit around the barrel of the firearm. The right leg 138 has a threaded hole 142. The left leg 136 has a hole 144 with a counterbore recess 146. A fastener (not shown) can be placed in the hole 144 and screwed into the threaded hole 142 to draw the two legs 136, 138 towards each other thereby clamping onto the barrel at the barrel hole 134. The pin receiving notch 140 is located on the rear side 148 of the block at the top of the barrel hole 134. The notch 140 receives a pin extending from the top of the barrel to relatively easily and accurately position the block 120 on the barrel. In the event the front sight becomes damaged or otherwise needs to be removed or placed, it is relatively easy to position a new replacement front sight at the same position on the barrel without the need of a skilled gunsmith as was necessary with the prior art transverse pin mounting system shown in FIG. 4. In the past, replacement of a barrel with a new barrel occurred by shipping the customer a combined barrel and front sight assembly (because the front sight had to be precisely located on the barrel). With the present invention a combined barrel and front sight assembly no longer needs to be sent to the customer. Instead, with the present invention only a new barrel needs to be sent without the need for sending a new front sight already attached to the barrel. The customer can merely remove the old front sight from the old barrel and use the old front sight with the new barrel. The keying pin on the barrel precisely locates the old front sight on the new barrel for proper alignment with the rear sight. The present invention also provides the advantage of interchangeability in different species of firearms in a family of M-16 style of firearms. In the prior art there were different patterns and locations of the holes in the barrels for pins 84 shown in the FIG. 4 for different barrels, such as 16 inch long barrels, 20 inch long barrels, barrels for use with flat-top receivers, and barrels for use with non-flat-top receivers. However, with the present invention, the same front sight and/or gas block can be used on different species of barrels because the mounting system used for each barrel is the same; a single keying pin extending from the top side of the barrel and the clamp-on block having a keying recess to receive the keying pin. The block 120 could also comprise an integral sling swivel mount and/or a bayonet lug.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A firearm comprising:

a receiver;

a barrel connected to a front end of the receiver;

a gas block clamped onto the barrel, the gas block having a one-piece member with a barrel receiving channel which has a portion of the barrel therein and at least one pair of lugs, respective ones of the lugs being located on opposite sides of the barrel receiving channel, and a fastener being removably connected to the pair of lugs to clamp the gas block to the barrel; and a gas tube extending between the receiver and the gas block, wherein the one-piece member of the gas block has a keyway extending into the one-piece member from a rear face of the one-piece member and the barrel has a key piece extending therefrom which is received in the keyway as the one-piece member is slid rearward on the barrel to position the gas block on the barrel at a predetermined position.

2. A firearm as in claim 1 wherein the gas block has a one piece body made from metal with the fastener threadably connected thereto to clamp the gas block to the barrel.

3. A firearm as in claim 1 wherein the gas block has at least two pairs of the lugs to clamp the gas block around and onto the barrel.

4. A firearm as in claim 1 wherein the gas block has an opening from the barrel receiving channel communicating with the gas tube.

5. A firearm as in claim 4 wherein the barrel has a port located so that the port in the barrel cooperates with the opening in the gas block to allow the gas tube to communicate with the barrel.

6. A firearm as in claim 1 wherein the one-piece member forms a portion of a front sight.

7. A firearm as in claim 6 wherein the one-piece member forms a bayonet lug.

8. In a gas operated firearm having a receiver, a stock connected to an end of the receiver, a barrel connected to a front of the receiver, a handguard connected to the barrel and a gas tube extending into the receiver, wherein the improvement comprises:

a gas block stationarily fixed to the barrel and having the gas tube connected thereto, the gas block having a one-piece member with a first pair of two cantilevered arm sections that extend along opposite sides of the barrel and are connected to each other by a fastener to clamp the barrel between the two arm sections, wherein the one-piece member of the gas block has a keyway extending into the one-piece member from a rear face of the one-piece member and the barrel has a key piece extending therefrom which is received in the keyway as the one-piece member is slid rearward on the barrel to position the gas block on the barrel at a predetermined position.

9. A firearm as in claim 8, wherein the gas block has a porthole communicating with the gas tube, the porthole being located so that the gas tube is connected to the barrel.

10. A firearm as in claim 8, wherein the gas block has a second pair of cantilevered arm sections and a second fastener, the cantilevered arm sections from each pair extending along opposite sides of the barrel and being connected by a corresponding one of the fasteners, and wherein the gas block has a front sight of the firearm projecting from the gas block.

11. A firearm comprising:

a receiver;

a barrel connected to a front of the receiver; and a gas block clamped onto the barrel;

wherein the gas block has a fastener removably connected thereto to removably clamp the gas block around and onto the barrel, wherein the gas block has a one-piece member with a keyway extending into the one-piece member from a rear face of the one-piece member and the barrel has a key piece extending therefrom which is received in the keyway as the one-piece member is slid rearward on the barrel to position the gas block on the barrel at a predetermined position.

12. A firearm as in claim 11, wherein the firearm further comprises a gas tube connected between the receiver and the gas block.

13. A firearm as in claim 12, wherein the gas block has a gas passage, the gas passage connecting the gas tube to the barrel.

14. A firearm as in claim 11, wherein the gas block has a second fastener removably connected thereto to clamp the gas block around and onto the barrel, and wherein the gas block has means for attaching a bayonet thereon.

15. A firearm as in claim 11 wherein the one-piece member forms a portion of a front sight.

16. A firearm as in claim 15 wherein the one-piece member forms a bayonet lug.

* * * * *